US012379116B1

(12) United States Patent
Romero, Jr. et al.

(10) Patent No.: US 12,379,116 B1
(45) Date of Patent: Aug. 5, 2025

(54) SMART AIR FILTRATION SYSTEM AND METHOD OF USE

(71) Applicant: UIPCO, LLC, San Antonio, TX (US)

(72) Inventors: Jose L. Romero, Jr., San Antonio, TX (US); Andre Rene Buentello, San Antonio, TX (US); Dustin Bowen Bitter, Lehi, UT (US); Nina Cooper, San Antonio, TX (US)

(73) Assignee: United Services Automobile Association (USAA), San Antonio, TX (US)

( * ) Notice: Subject to any disclaimer, the term of this patent is extended or adjusted under 35 U.S.C. 154(b) by 609 days.

(21) Appl. No.: 17/732,779

(22) Filed: Apr. 29, 2022

(51) Int. Cl.

| | |
|---|---|
| ***F24F 7/003*** | (2021.01) |
| ***F24F 7/08*** | (2006.01) |
| ***F24F 11/56*** | (2018.01) |
| ***F24F 13/10*** | (2006.01) |
| *F24F 110/50* | (2018.01) |
| *F24F 110/72* | (2018.01) |

(52) U.S. Cl.
CPC ..... *F24F 7/003* (2021.01); *F24F 7/08* (2013.01); *F24F 11/56* (2018.01); *F24F 13/10* (2013.01); *F24F 2110/50* (2018.01); *F24F 2110/72* (2018.01)

(58) Field of Classification Search
CPC .... F24F 7/003; F24F 7/08; F24F 11/56; F24F 13/10; F24F 2110/50; F24F 2110/72
USPC ..... 454/239
See application file for complete search history.

(56) References Cited

U.S. PATENT DOCUMENTS

| | | | | |
|---|---|---|---|---|
| 4,079,888 | A * | 3/1978 | Briscoe | F28D 21/0008 237/55 |
| 4,300,527 | A * | 11/1981 | Montague | F23L 11/02 237/55 |
| 5,191,874 | A * | 3/1993 | McWilliams | F24F 7/08 237/48 |
| 10,126,009 | B2 * | 11/2018 | Flaherty | F24F 11/58 |
| 11,067,307 | B2 * | 7/2021 | Heintzelman | F24F 11/59 |
| 11,215,372 | B2 * | 1/2022 | Gonia | F24F 11/0001 |
| 2007/0204862 | A1 * | 9/2007 | Cowan | F23N 3/042 126/85 B |
| 2009/0065595 | A1 * | 3/2009 | Kates | F24F 11/76 236/49.3 |

(Continued)

FOREIGN PATENT DOCUMENTS

| | | | | |
|---|---|---|---|---|
| GB | 2039358 | A * | 8/1980 | F23L 11/005 |

*Primary Examiner* — Avinash A Savani
*Assistant Examiner* — Dana K Tighe
(74) *Attorney, Agent, or Firm* — Plumsea Law Group, LLC

(57) ABSTRACT

The embodiments provide a system and method for filtering out smoke and/or toxic gases/fumes from air in a building. The system integrates various smart devices with an HVAC system along with a controlling software application that can change the state of the smart devices, thereby controlling the types and quantities of air moving through the HVAC system at any time. In particular, the system can adjust the openings of one or more smart registers to control how much air passes in and out of the HVAC system over a given period of time. The system can also adjust the opening of a smart intake vent to control how much fresh (outside) air passes into the system over a given period of time. The system can also adjust the opening of a smart furnace valve that is disposed within the furnace.

20 Claims, 7 Drawing Sheets

(56) References Cited

U.S. PATENT DOCUMENTS

| | | | | |
|---|---|---|---|---|
| 2019/0195528 | A1* | 6/2019 | Puranen | F24F 11/81 |
| 2023/0028955 | A1* | 1/2023 | Seo | F24F 11/61 |

* cited by examiner

SMART AIR FILTRATION SYSTEM AND METHOD OF USE

TECHNICAL FIELD

The present disclosure generally relates to HVAC systems, and in particular, to methods of filtering air using HVAC systems.

BACKGROUND

Many buildings (including homes, apartments, and commercial offices) have heating, ventilation, and air conditioning (HVAC) systems that facilitate heating and cooling air in the building. HVAC systems may include a furnace, an air conditioning unit, and ducts that deliver air to and from these components. HVAC systems may typically recycle air within a building, to save the energy that would be required to continuously heat and/or cool outside air. In the event of a fire or other event that generates smoke or toxic fumes in a building, the harmful air may be recycled through the HVAC system. While many HVAC systems include filters at the junction between the primary return duct and the furnace, these filters are not sufficient to filter out smoke and/or other toxic fumes.

There is a need in the art for a system and method that addresses the shortcomings discussed above.

SUMMARY

In one aspect, a furnace for venting smoke and fumes from a building, where the furnace is connected to a ductwork system having a supply duct and a return duct, includes a circulated air system for heating air from the return duct and circulating the heated air through the supply duct, an exhaust air system for venting air associated with the combustion process in the furnace, and a valve connecting the circulated air system and the exhaust air system, such that when the valve is open, air from the circulated air system can pass through to the exhaust air system.

In another aspect, a smart filtration system for filtering air in a building, where the building includes a ductwork system with a supply duct and a return duct, includes a smart supply register connected to the supply duct and a smart return register connected to the return duct and a furnace. The furnace includes a circulated air system for heating air from the return duct and circulating the heated air through the supply duct, an exhaust air system for venting air associated with the combustion process in the furnace, and a smart valve connecting the circulated air system and the exhaust air system, such that when the valve is open, air from the circulated air system can pass through to the exhaust air system. The system also includes a computing device comprising a processor and memory storing instructions that are executable by the processor to receive information about air quality from a remote device, and in response to receiving information about the air quality, controlling at least one of the smart valve, the smart supply register, or the smart return register.

In another aspect, a computer implemented method for filtering air from a building with an HVAC system in response to detecting a filtration trigger includes receiving information from a remote device, detecting a filtration trigger, sending a command to open a smart intake vent, where the smart intake vent is connected to a fresh air intake of the HVAC system, sending a command to partially close a smart register, wherein the smart register is connected to a duct of the HVAC system, and sending a command to partially open a smart furnace valve, where the smart furnace valve is disposed within a furnace of the HVAC system, and where opening the smart furnace valve allows air to pass from a blower chamber of the furnace to a combustion chamber of the furnace.

Other systems, methods, features, and advantages of the disclosure will be, or will become, apparent to one of ordinary skill in the art upon examination of the following figures and detailed description. It is intended that all such additional systems, methods, features, and advantages be included within this description and this summary, be within the scope of the disclosure, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The embodiments provide a system and method for filtering out smoke and/or toxic gases/fumes from air in a building. The system integrates various smart devices with an HVAC system along with a controlling software application that can change the state of the smart devices, thereby controlling the types and quantities of air moving through the HVAC system at any time. In particular, the system can adjust the openings of one or more smart registers to control how much air passes in and out of the HVAC system over a given period of time. The system can also adjust the opening of a smart intake vent to control how much fresh (outside) air passes into the system over a given period of time. The system can also adjust the opening of a smart furnace valve that is disposed within the furnace. The smart furnace valve is positioned such that when open, some of the air circulating through the HVAC system (and the building) can enter a combustion chamber of the furnace. Once in the combustion chamber, the air can be vented out an exhaust pipe/vent, along with gases generated by the combustion process.

The proposed systems and methods provide an improvement over existing systems that do not provide a way for air circulating through the HVAC system (and building) to be vented into the furnace's combustion chamber and out the exhaust pipe. By venting some of the circulated air, and continuously adding new fresh air to the circulating air, the proposed system can filter out a substantial amount of smoke and toxic gases/fumes from the circulated air. In particular, the air can be filtered such that occupants are able to breathe the air without suffocating, as they attempt to escape from the fire.

Various terms are gathered and defined here for convenience.

As used herein, the term "fluid communication" describes the ability of a fluid, such as a gas, to pass between two or more components. That is, two components may be in fluid communication if gas can pass from one component to the other.

A "valve" is any device that connects two components and controls the degree to which these two components are in fluid communication. When the valve is closed, the two components are not in fluid communication. When the valve is open, the two components are in fluid communication.

As used herein a "smart" device or component is a device that can be connected to other devices over a network, and which may therefore be operated remotely. Thus, smart devices may be understood to include at least a communication component, such as a WiFi card or a Bluetooth radio, for communicating with other devices. Each smart device may also be understood to include at least a processor and memory for storing instructions that can be executed by the processor.

Figure 1:
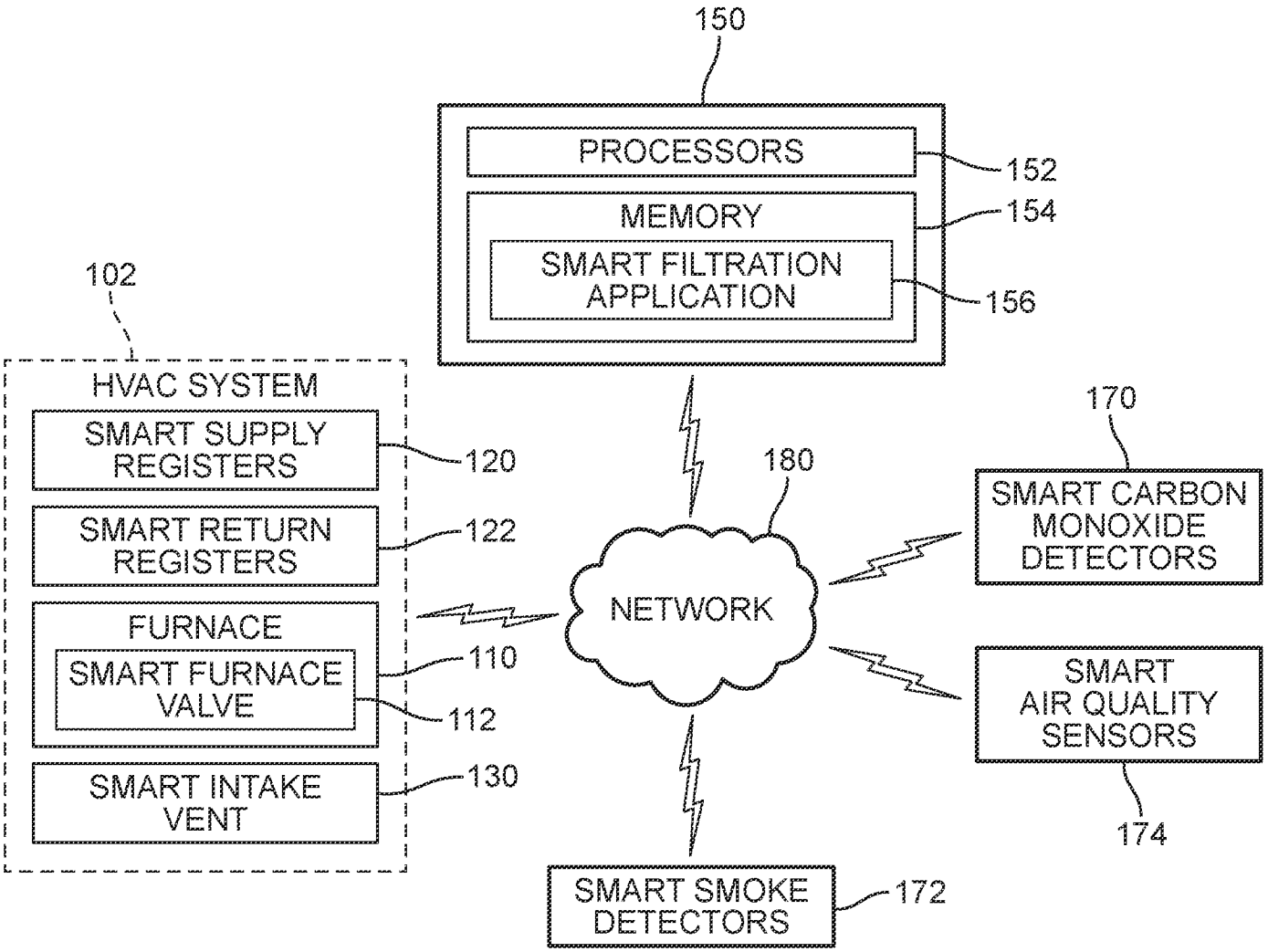
FIG. 1 is a schematic view of components associated with a smart air filtration system for a building, according to an embodiment.

FIG. 1 is a schematic view of some components of a smart filtration system 100 ("system 100") that may be used to filter out smoke and/or toxic fumes from a building. Referring to FIG. 1, system 100 may further include an HVAC system 102, a computing system 150 and one or more smart detectors (including smart carbon monoxide detectors 170 and smart smoke detectors 172). System 100 may also include one or more smart air quality sensors 174.

Generally, an HVAC system may include components for heating and cooling air (such as a furnace and an air conditioning unit), as well as components for moving air through a building (including ductwork, registers or vents, exhaust pipes, and other components). For purposes of clarity, only some components of HVAC system 102 are indicated in FIG. 1. These include a furnace 110. Furnace 110 includes components for heating air, which are described in further detail below. In the exemplary embodiment, HVAC system 102 may comprise various smart components. These include one or more smart supply registers 120, one or more smart return registers 122, a smart intake vent 130, and a smart furnace valve 112. Each of these smart components, which may be alternatively referred to as internet of things (IoT) devices, may be controllable to change states, possibly in response to commands from a remote system (such as computing system 150).

Smart registers, including smart supply registers 120 and smart return registers 122 may be motorized registers that can open and close in response to electric signals. Similarly, smart intake vent 130 may be a motorized vent that can open and close in response to electric signals. Moreover, both smart registers and smart intake vents can be adjusted to various partially open positions between fully opened and fully closed. The degree to which a register or vent is open may control the amount of air flowing in or out of the register/vent.

For purposes of illustration, HVAC system 102 is shown without an air conditioning unit, as the air conditioning unit may not be utilized in filtering air in the methods described below.

Computing system 150 may include processors 152 and memory 154. Memory 154 may comprise a non-transitory computer readable medium. Instructions stored within memory 154 may be executed by the one or more processors 152. Computing system 150 may also include one or more networking components (such as a WiFi card, Bluetooth radio, or other suitable components), which are not shown here. Computing system 150 may store and execute a smart filtration application 156. Using the resources of computing system 150, smart filtration application 156 may communicate with various smart components and control the operation of those smart components. Specifically, smart filtration application 156 may receive information from one or more smart detectors and, in response, send commands to change the state of one or more smart components associated with HVAC system 102, as described in further detail below.

Each of the smart components, as well as computing system 150 may communicate over one or more networks, such as network 180. Network 180 may be any suitable network and may comprise a wireless local area network in some embodiments.

Although the embodiments show computing system 150 as separate from HVAC system 102, in other embodiments computing system 150 could be integrated into one or more components of HVAC system 102. For example, in some embodiments, computing system 150 could be integrated into furnace 110. In other embodiments, where a smart filtration system is added to an existing HVAC system, computing system 150 could be a separate system/device that is placed within the building. In still other embodiments, computing system 150 could be a remote system that communicates with various smart devices over a wide area network, such as the Internet.

Figure 2:
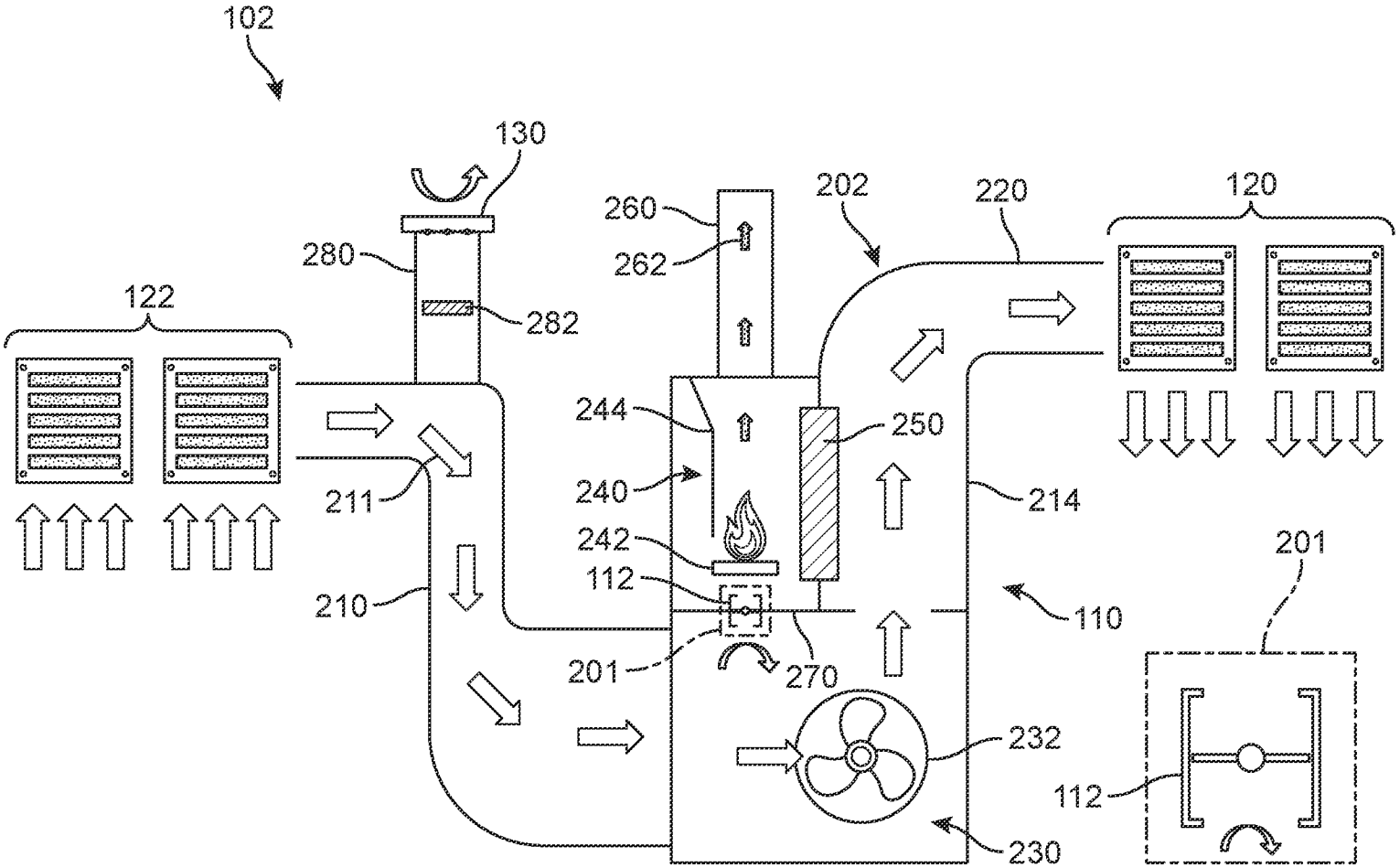
FIG. 2 is a schematic view of components of a smart air filtration system integrated with components of an HVAC system, according to an embodiment.

FIG. 2 is a schematic view of some components of HVAC system 102, including furnace 110. HVAC system 110 further includes a ductwork system 202 that circulates air through a building. For purposes of illustration, only some portions of ductwork system 202 are shown. Ductwork system 202 may include multiple return ducts, of which a single representative return duct 210 is shown in FIG. 2. Return duct 210 is connected, possibly by other ducts, to one or more of smart return registers 122. Return duct 210 is also connected, at one end, to furnace 110.

Ductwork system 202 may also include multiple supply ducts. In FIG. 2, a single portion of a representative supply duct 220 is shown. Supply duct 220 is connected, possibly by other ducts, to one or more of smart supply registers 120. Supply duct 220 is also connected, at one end, to a supply plenum 214 of furnace 110.

Furnace 110 may comprise multiple components. For clarity, only some components are shown in FIG. 2. Furnace 110 may include a blower chamber 230 that houses a blower 232. Blower chamber 230 may be connected to return duct 210, so that air from return duct 210 can be drawn into furnace 110 through blower chamber 230.

Furnace 110 may also include a combustion chamber 240 that houses a burner 242. Although not shown, burner 242 may be further equipped with a flame sensor, as well as a pilot or hot surface ignitor. Burner 242 may burn gas or oil. For clarity, the delivery line for gas or oil is not shown in the figures. Combustion chamber 240 may also include a burner cover 244, which separates the area of combustion from other components of the burner such as the gas control valve (not shown).

Furnace 110 may also include a heat exchanger 250. Heat exchanger 250 acts to transfer heat generated by burning the fuel (gas or oil) to air that is circulated through the furnace at supply plenum 214, thereby heating up the circulated air.

During the combustion process, toxic fumes may be generated within combustion chamber 240. To prevent these fumes from mixing with the air circulated through the furnace, two separate air systems may be maintained within the furnace. These include a circulated air system and an exhaust air system. The circulated air system comprises air that enters the furnace from the return duct and exits (after being heated) through the supply duct. In FIG. 2, the circulated air system includes circulated air 211.

The exhaust air system comprises air that is pulled into the combustion chamber using a draft inducer fan (not shown). The resultant gases from the combustion process may be vented through an exhaust pipe 260 as exhaust air 262. For purposes of illustration, exhaust air 262 is indicated with relatively smaller arrows than the arrows used to indicate circular air 211.

Conventional furnaces may keep these air systems separated at all times, so that exhaust air from the combustion chamber does not escape into the supply ducts, and thereby get circulated through the building. However, the exemplary embodiments provide a smart furnace valve 112 to facilitate mixing these air systems when necessary. As described in further detail below, the use of smart furnace valve 112 allows some circulated air to pass into the combustion chamber, where the circulated air can be vented out of the exhaust pipe along with the exhaust air from combustion. This may be used to vent circulated air that has collected smoke and fumes from a fire or other source in the building.

In one embodiment, smart furnace valve 112 may be positioned at an interface between blower chamber 230 and combustion chamber 240. In the exemplary embodiment, smart furnace valve 112 may be placed within a barrier wall 270 that would otherwise prevent air from passing from blower chamber 230 to combustion chamber 240. In some cases, smart furnace valve 112 is positioned such that air passing through the valve enters combustion chamber 240 behind burner cover 244.

For clarity, smart furnace valve 112 is shown schematically in the enlarged view 201 within FIG. 2. It may be appreciated that any suitable electric valves could be used, including, for example, any suitable solenoid valves.

In some embodiments, a smart furnace valve could be installed within a furnace at the time of manufacturing. However, in embodiments where an existing HVAC system is retrofitted with a smart filtration system, it may be necessary to install the smart furnace valve within an existing furnace at a location at the interface of the blower and combustion chambers. More generally, the valve may be placed in any location such that air enters the combustion chamber behind the burner cover.

HVAC system 102 may also include a fresh air intake 280 that is connected to return duct 210 (or to another duct upstream of return duct 210). Fresh air intake 280 may be open on an exterior of a building, thereby providing a way for fresh (outside) air to enter the circulating air system within the building. In some cases, fresh air intake 280 can include a filter 282, for filtering air entering the building.

In some cases, HVAC system 102 may operate as a closed air system so that air is only recirculated through the building. In some cases, smart intake vent 130 may be used to selectively control whether outside air can enter fresh air intake 280.

Smart registers, including smart supply registers 120 and smart return registers 122 can comprise motorized registers that can be opened and closed via electric signals. Moreover, the smart registers may be equipped to send and receive information (including control commands) over a network.

Likewise, smart air intake vent 130 can comprise a motorized vent that can be opened and closed via electric signals. Moreover, smart intake vent 130 may be equipped to send and receive information (including control commands) over a network.

Smart furnace valve 112 may also comprise an electric valve (such as a solenoid valve) that can be opened and closed via electric signals. Moreover, smart furnace valve 112 may be equipped to send and receive information (including control commands) over a network.

In FIG. 2, the smart filtration system is operated in a normal, or non-filtering state. In this state, smart supply registers 120 and smart return registers 122 are fully open, so that air can circulate through the building and HVAC system. In addition, smart intake vent 130 is closed, since fresh air is not needed at this time.

In this normal state of operation, smart furnace valve 112 is also closed, as shown in the enlarged view within FIG. 2. With this valve closed, air cannot pass from blower chamber 230 into combustion chamber 240.

In this configuration, circulated air 211 from the building enters the HVAC system through smart return registers 122. This air travels through to return duct 210 and enters blower chamber 230. In some cases, blower 232 facilitates drawing air from return duct 210 into furnace 210, and then pushes air into supply plenum 214 so that it can be heated by heat exchanger 250. The newly heated air then passes through supply duct 220 and eventually back into rooms of the building via smart supply registers 120.

It may be appreciated that the system can include conventional filters that are installed at the interface between return duct 210 and blower chamber 230. However, these filters would generally be configured to filter out particulates from substantially "clean" air. In particular, in the presence of smoke or other fumes, these filters would not be able to clean out nearly enough particulate matter to make a difference in the air quality.

Figure 3:
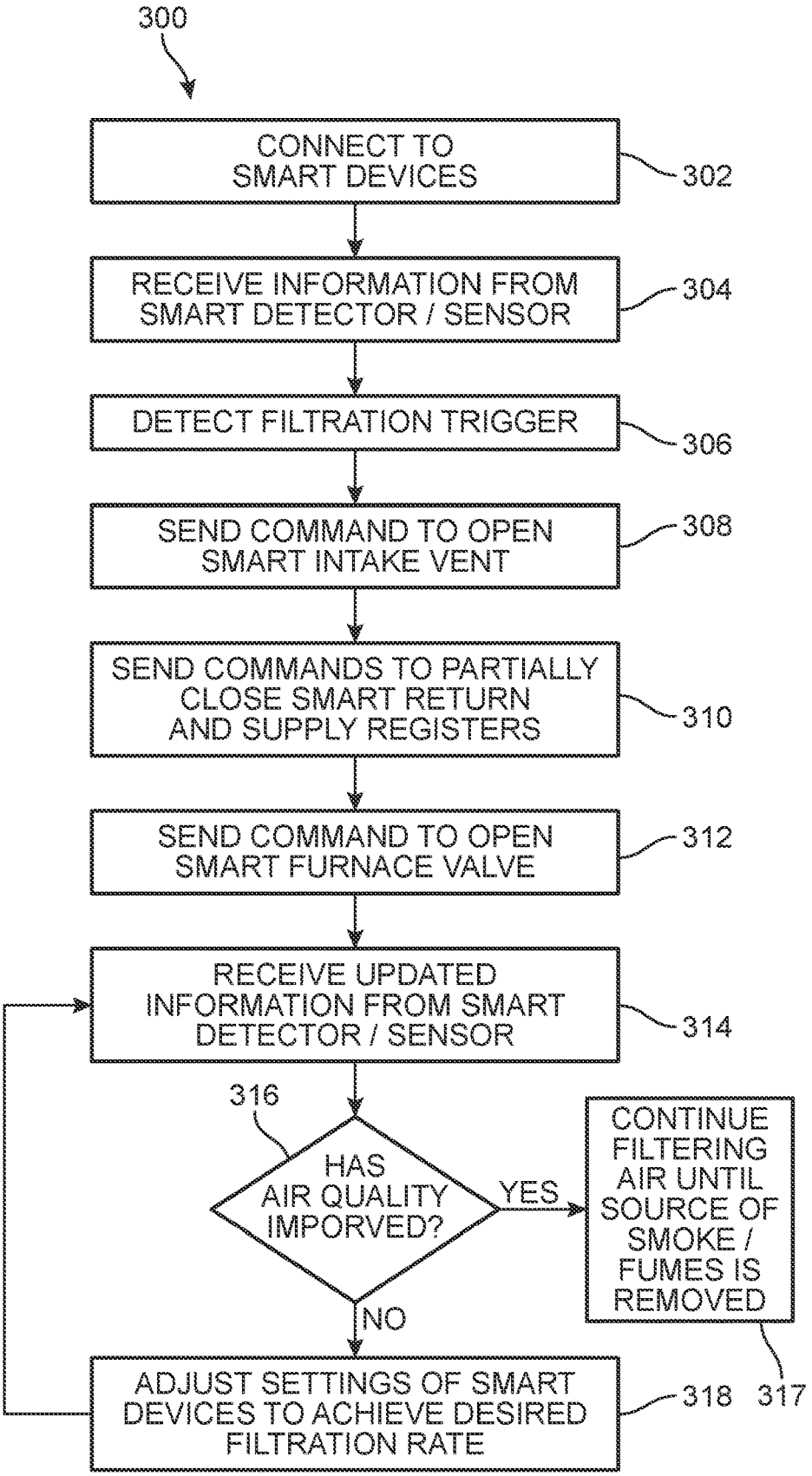
FIG. 3 is a view of a process for operating smart devices in a smart air filtration system to filter air in a building, according to an embodiment.

FIG. 3 is a schematic view of a process 300 for operating a smart filtration system, according to an embodiment. Moreover, FIGS. 4-7 depict various states of an HVAC system, as the system is controlled according to various steps of process 300. In some embodiments, one or more of these steps could be performed by smart filtration application 156, which runs on computing system 150 (see FIG. 1).

Starting in step 302, smart filtration application 156 (or simply "application 156") may initially be connected to various smart devices. This may include establishing communication with smart furnace valve 112, smart intake vent 130, smart registers (such as smart return registers 122 and smart supply registers 120), smart detectors (such as smart carbon monoxide detectors 170 and smart smoke detectors 172), and smart air quality sensors 174.

In step 304, application 156 receives information from a smart detector, such as a smart smoke or carbon monoxide detector. This information may include information about a smoke alarm or carbon monoxide alarm that is being generated by the smart detector(s). These alarms could occur in the event of a fire. Alternatively, or in combination with information received from smart detectors, application 156 could receive information from one or more smart air quality sensors. These sensors may be configured to continuously monitor the quality of air in a building, and may sense not only smoke and carbon monoxide, but possibly other toxic gases and/or harmful particulate matter.

Figure 4:
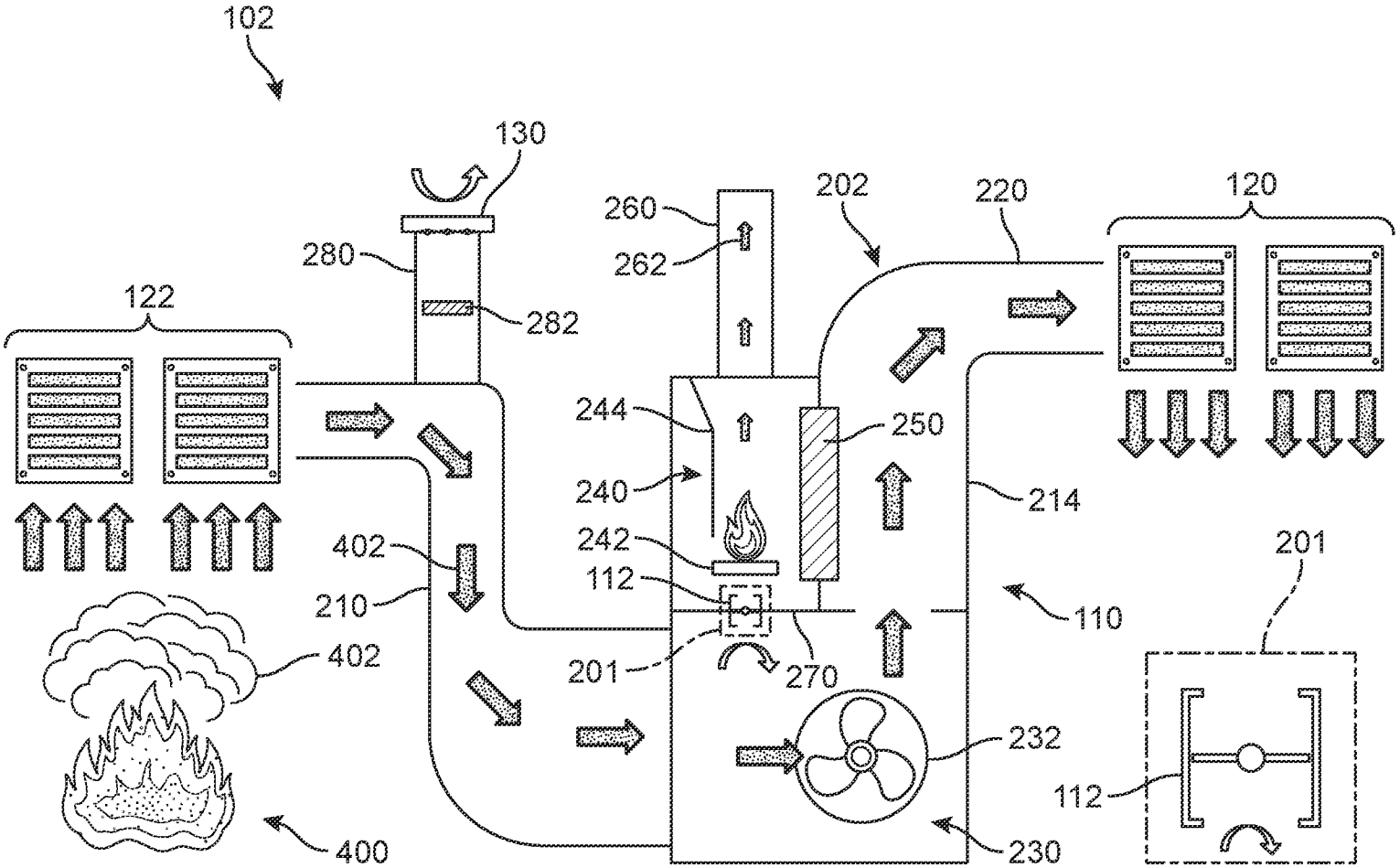
FIGS. 4-7 are schematic views of a smart filtration system operating during a fire in a building to filter out smoke and toxic fumes from the air.

To demonstrate one possible scenario where the smart filtration process of FIG. 3 may be useful, FIG. 4 shows a configuration where a fire 400 has started in a building. In this configuration smoke 402 from fire 400 has been drawn into HVAC system 102 via smart return registers 122. This creates a hazardous air flow 402 (indicated by thick shaded arrows), comprised of smoke, carbon monoxide and possibly other toxic fumes. Hazardous air flow 402 flows through return duct 210, furnace 110, and eventually gets recirculated back into the building's rooms through smart supply registers 120. In this mode, HVAC system 102 acts to recirculate smoky and toxic air that may inhaled by inhabitants of the building as they attempt to exit from fire 400.

Referring back to process 300 in FIG. 3, in response to receiving information from a smart detector or sensor, application 156 may detect a filtration trigger, in step 306. That is, application 156 determines, based on information received from one or more smart detectors/sensors, that air filtration is needed to ensure the air in the building remains breathable for occupants.

In response to the filtration trigger, application 156 sends commands to open the smart intake vent (step 308), as well as commands to partially close the smart return and supply registers (step 310). Application 156 also sends a command to open the smart furnace valve (step 312).

Figure 5:
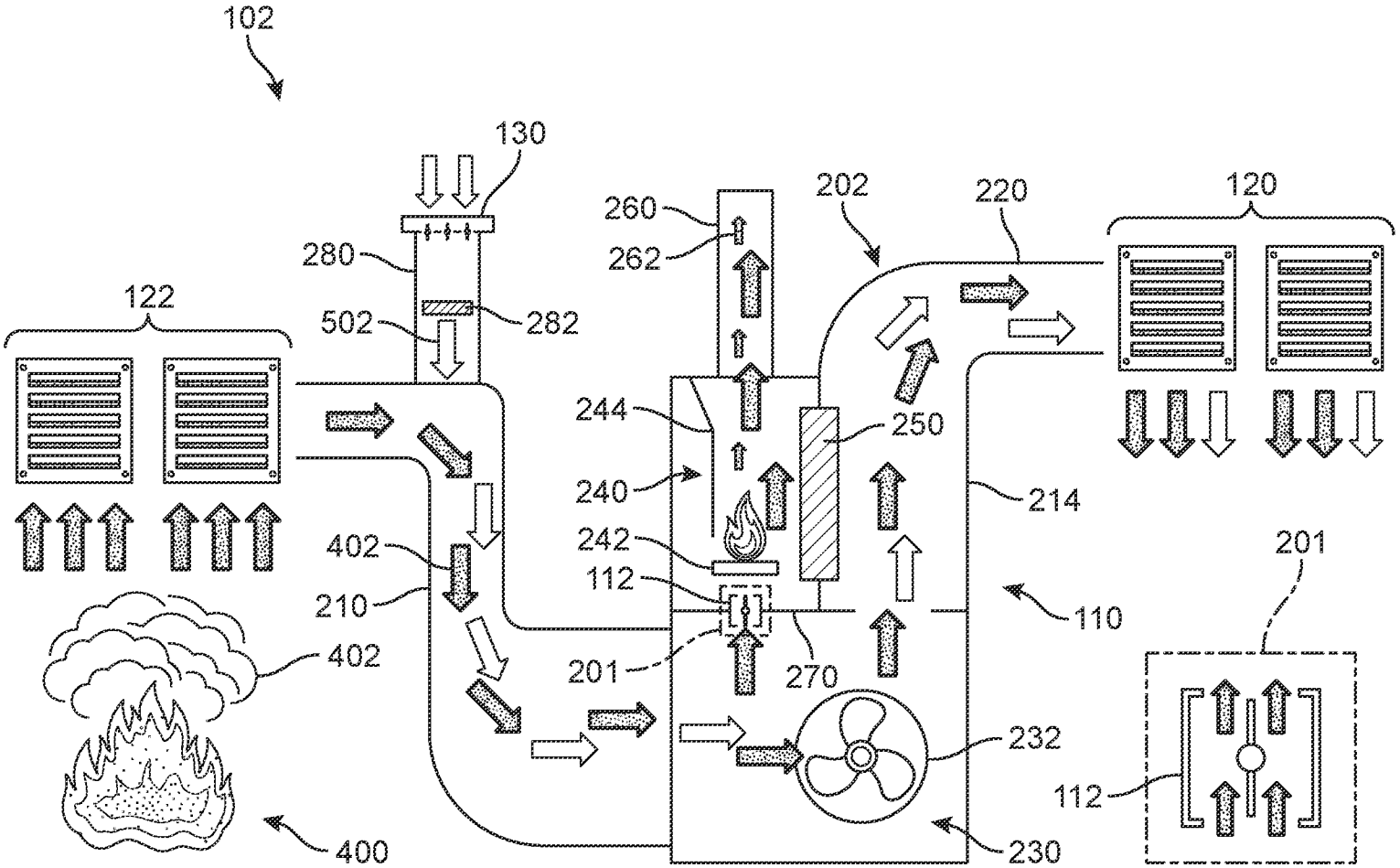

FIG. 5 is a schematic view of a configuration of the exemplary system in which the smart registers have been partially closed, and in which the smart intake vent and smart furnace valve have both been opened. With smart return registers 122 partially closed, less smoke or fumes enter the HVAC system. With smart supply registers 120 partially closed, less smoke or fumes can exit the HVAC system back into rooms of the building. In addition, with smart intake vent 130 open, fresh air 502 has been introduced to the return duct 210.

With smart furnace valve 112 open, smoke and fumes may pass from blower chamber 230 directly into combustion chamber 240 (and behind burner cover 244). This allows the smoke and fumes that might otherwise have recirculated through the building to be vented out of exhaust pipe 260 along with exhaust air 262.

Figure 6:
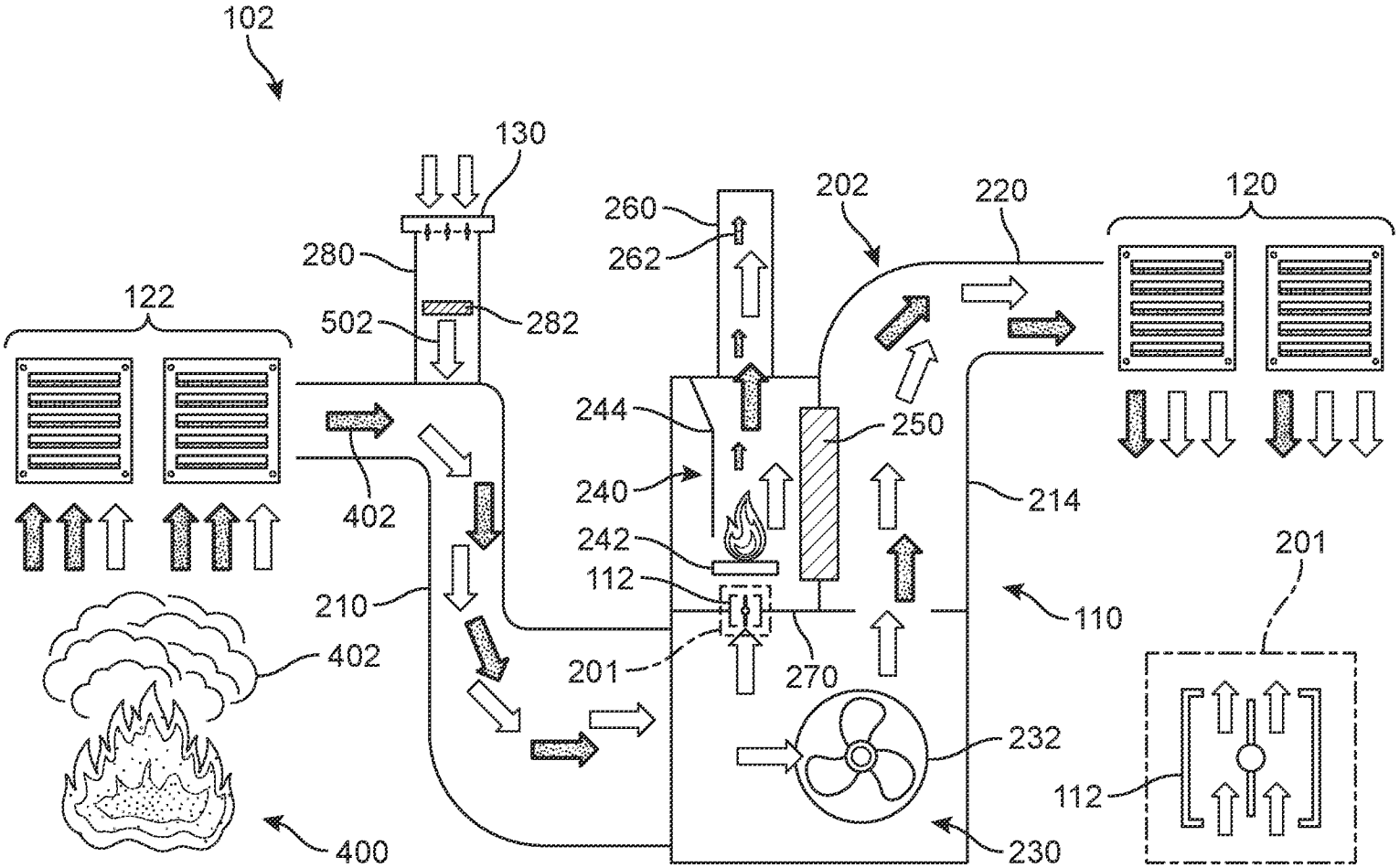

As shown in FIG. 6, with sufficient time, more smoke and fumes are filtered out of the air that is circulated through the HVAC system. As long as the amount of fresh air entering via fresh air intake 280 is greater than the amount of air introduced through smart return registers 122, the amount of smoke and fumes in the circulated air will continue to be reduced. This occurs since some volume of the circulated air is continually vented through smart furnace valve 112 and exhaust pipe 260, as additional fresh air is continually added (at fresh air intake 280) in a volume that is greater than the volume lost to vented air.

Returning to process 300 of FIG. 3, application 156 could continue to monitor information from smart detectors and sensors in step 314. If the air quality has improved (in step 316), application 156 may operate the HVAC system in its current state to continue filtering air until the source of the smoke/fumes has been removed (for example, a fire has been put out), in step 317. If the air quality has not improved, or not improved quickly enough, application 156 may adjust settings of one or more smart devices to achieve a desired filtration rate. These adjustments may include adjusting the degree to which the one or more smart registers are open, the degree to which the smart intake vent is open, and the degree to which the smart furnace valve is open. By adjusting one or more of these systems, the ratio of fresh air to smoky/toxic air passing through the HVAC system can be adjusted, along with the amount of air (including a combination of fresh air and smoky/toxic air) that is vented through the exhaust pipe.

Figure 7:
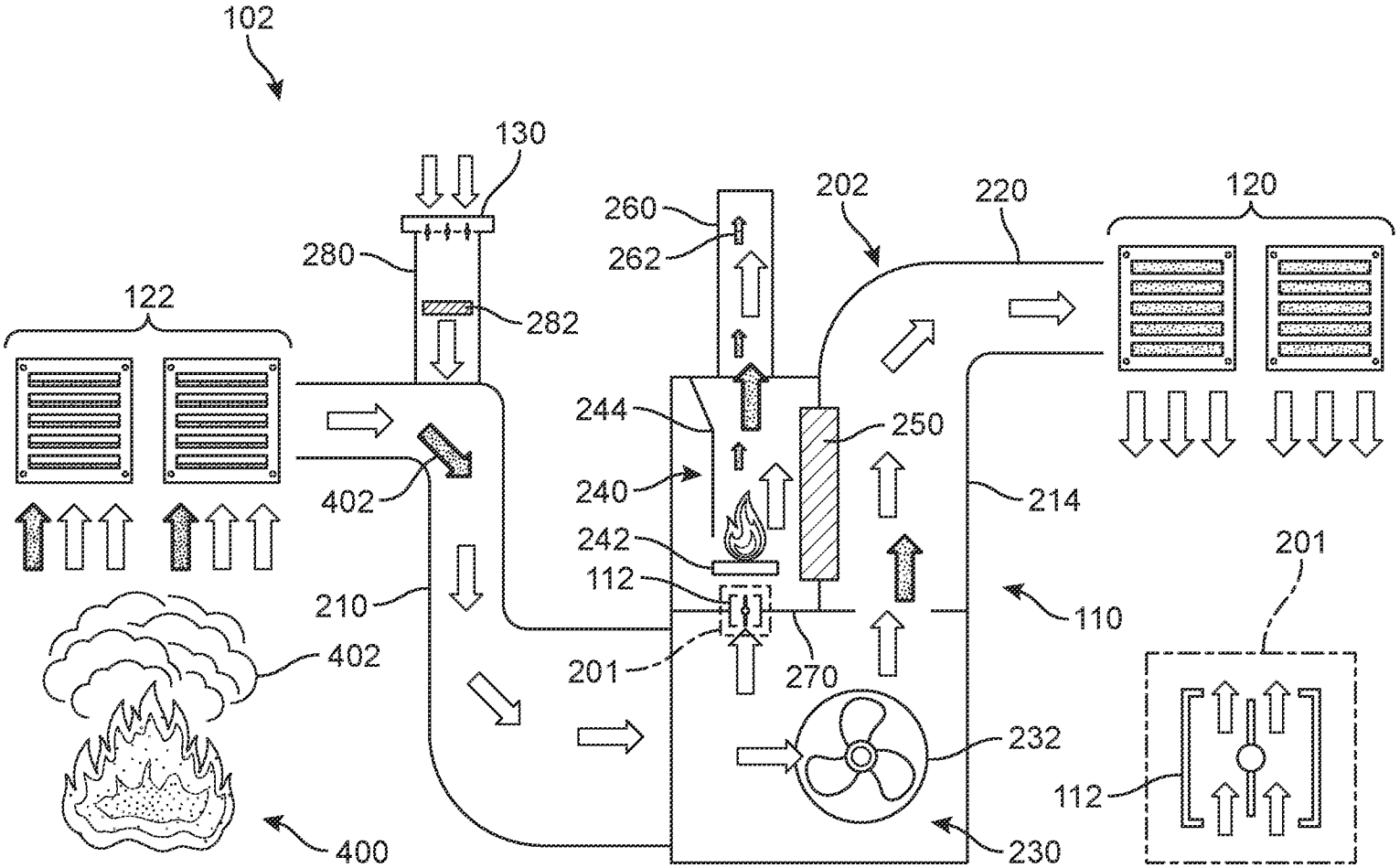

Eventually, as in the configuration shown in FIG. 7, the majority of smoke and fumes may be removed from the circulating air such that most of the air returned via smart supply registers 110 is fresh air. Even as new smoke and fumes may be produced by an ongoing fire, the rate that air with smoke and fumes is replaced with fresh air is such that the air can be safely breathed by occupants as they make their escape from the building. In some cases, at this point, supply registers 120 could be opened fully, to allow mostly fresh air to enter back into the rooms of the building at a faster rate.

The exemplary systems and methods therefore allow occupants to breathe clean air and escape before suffocating from smoke during a fire. Also, in situations where toxic gases or large particulate matter are released into the building's air from other sources, the systems and methods allow occupants to breathe clean air, even before they may recognize there is a problem with the air quality.

The processes and methods of the embodiments described in this detailed description and shown in the figures can be implemented using any kind of computing system having one or more central processing units (CPUs) and/or graphics processing units (GPUs). The processes and methods of the embodiments could also be implemented using special purpose circuitry such as an application specific integrated circuit (ASIC). The processes and methods of the embodiments may also be implemented on computing systems including read only memory (ROM) and/or random access memory (RAM), which may be connected to one or more processing units. Examples of computing systems and devices include, but are not limited to: servers, cellular phones, smart phones, tablet computers, notebook computers, e-book readers, laptop or desktop computers, all-in-one computers, as well as various kinds of digital media players.

The processes and methods of the embodiments can be stored as instructions and/or data on non-transitory computer-readable media. The non-transitory computer readable medium may include any suitable computer readable medium, such as a memory, such as RAM, ROM, flash memory, or any other type of memory known in the art. In some embodiments, the non-transitory computer readable medium may include, for example, an electronic storage device, a magnetic storage device, an optical storage device, an electromagnetic storage device, a semiconductor storage device, or any suitable combination of such devices. More specific examples of the non-transitory computer readable medium may include a portable computer diskette, a floppy disk, a hard disk, magnetic disks or tapes, a read-only memory (ROM), a random access memory (RAM), a static random access memory (SRAM), a portable compact disc read-only memory (CD-ROM), an erasable programmable read-only memory (EPROM or Flash memory), electrically erasable programmable read-only memories (EEPROM), a digital versatile disk (DVD and DVD-ROM), a memory stick, other kinds of solid state drives, and any suitable combination of these exemplary media. A non-transitory computer readable medium, as used herein, is not to be construed as being transitory signals, such as radio waves or other freely propagating electromagnetic waves, electromagnetic waves propagating through a waveguide or other transmission media (e.g., light pulses passing through a fiber-optic cable), or electrical signals transmitted through a wire.

Instructions stored on the non-transitory computer readable medium for carrying out operations of the present invention may be instruction-set-architecture (ISA) instructions, assembler instructions, machine instructions, machine dependent instructions, microcode, firmware instructions, configuration data for integrated circuitry, state-setting data, or source code or object code written in any of one or more programming languages, including an object oriented programming language such as Smalltalk, C++, python, java, or suitable language, and procedural programming languages, such as the "C" programming language or similar programming languages.

Aspects of the present disclosure are described in association with figures illustrating flowcharts and/or block diagrams of methods, apparatus (systems), and computing products. It will be understood that each block of the flowcharts and/or block diagrams can be implemented by computer readable instructions. The flowcharts and block diagrams in the figures illustrate the architecture, functionality, and operation of possible implementations of various disclosed embodiments. Accordingly, each block in the flowchart or block diagrams may represent a module, segment, or portion of instructions. In some implementations, the functions set forth in the figures and claims may occur in an alternative order than listed and/or illustrated.

The embodiments may utilize any kind of network for communication between separate computing systems. A network can comprise any combination of local area networks (LANs) and/or wide area networks (WANs), using both wired and wireless communication systems. A network may use various known communications technologies and/or protocols. Communication technologies can include, but are not limited to: Ethernet, 802.11, worldwide interoperability for microwave access (WiMAX), mobile broadband (such as CDMA, and LTE), digital subscriber line (DSL), cable internet access, satellite broadband, wireless ISP, fiber optic internet, as well as other wired and wireless technologies. Networking protocols used on a network may include transmission control protocol/Internet protocol (TCP/IP), multiprotocol label switching (MPLS), User Datagram Protocol (UDP), hypertext transport protocol (HTTP), hypertext transport protocol secure (HTTPS) and file transfer protocol (FTP) as well as other protocols.

Data exchanged over a network may be represented using technologies and/or formats including hypertext markup language (HTML), extensible markup language (XML), Atom, JavaScript Object Notation (JSON), YAML, as well as other data exchange formats. In addition, information transferred over a network can be encrypted using conventional encryption technologies such as secure sockets layer (SSL), transport layer security (TLS), and Internet Protocol security (Ipsec).

While various embodiments of the invention have been described, the description is intended to be exemplary, rather than limiting, and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A furnace for venting smoke and fumes from a building, wherein the furnace is connected to a ductwork system having a supply duct and a return duct, the furnace further comprising:

a blower chamber connected to the supply duct and the return duct, the blower chamber including a blower;

a combustion chamber connected to an exhaust pipe, the blower chamber including a burner for combustion;

a valve connecting the blower chamber with the combustion chamber;

wherein when the valve is closed, air passing through the blower chamber is prevented from entering the combustion chamber; and wherein when the valve is open, air passing through the blower chamber enters the combustion chamber and exits the furnace through the exhaust pipe.

2. The furnace according to claim 1, wherein the valve is an electric valve that can be remotely controlled.

3. The furnace according to claim 2, wherein the valve is smart valve that can communicate, over a network, with a remote computing system.

4. The furnace according to claim 1, wherein the valve is a solenoid valve.

5. The furnace according to claim 1, wherein the valve is configured to be opened in response to detecting smoke in the building.

6. The furnace according to claim 1, wherein the furnace includes a burner and a burner ignition mechanism within the combustion chamber, and wherein the valve is disposed beneath the burner ignition mechanism.

7. A smart filtration system for filtering air in a building, wherein the building includes a ductwork system with a supply duct and a return duct, the smart filtration system comprising:

a smart supply register connected to the supply duct and a smart return register connected to the return duct;

a furnace, the furnace further comprising:

a blower chamber connected to the supply duct and the return duct, the blower chamber including a blower;

a combustion chamber connected to an exhaust pipe, the combustion chamber including a burner for combustion;

a smart valve connecting the blower chamber with the combustion chamber;

wherein when the smart valve is closed, air passing through the blower chamber is prevented from entering the combustion chamber; and wherein when the smart valve is open, air passing through the blower chamber enters the combustion chamber and exits the furnace through the exhaust pipe;

a computing device comprising a processor and memory storing instructions that are executable by the processor to:

receive information about air quality from a remote device; and in response to receiving information about the air quality, controlling at least one of the smart valve, the smart supply register, or the smart return register.

8. The smart filtration system according to claim 7, wherein the smart valve is a solenoid valve.

9. The smart filtration system according to claim 7, wherein the remote device is an air quality sensor.

10. The smart filtration system according to claim 7, wherein the remote device is a smoke detector.

11. The smart filtration system according to claim 7, wherein the remote device is a carbon monoxide detector.

12. The smart filtration system according to claim 7, wherein the building includes a fresh air intake disposed on an exterior of the building, the fresh air intake being in fluid communication with the return duct, and wherein smart filtration system further comprises a smart intake vent connected to a fresh air intake.

13. The smart filtration system according to claim 12, wherein the instructions are further executable to:

adjust the positions of one or more of the smart valve, the smart intake vent, the smart return register and the smart supply register to filter the air in the building.

14. A computer implemented method for filtering air from a building with an HVAC system in response to detecting a filtration trigger, comprising:

receiving information from a remote device;

detecting the filtration trigger;

sending a command to open a smart intake vent, wherein the smart intake vent is connected to a fresh air intake of the HVAC system;

sending a command to partially close a smart register, wherein the smart register is connected to a duct of the HVAC system; and sending a command to partially open a smart furnace valve, wherein the smart furnace valve is disposed within a furnace of the HVAC system, and wherein opening the smart furnace valve allows air to pass from a blower chamber of the furnace to a combustion chamber of the furnace.

15. The computer implemented method of claim 14, wherein the remote device is an air quality sensor.

16. The computer implemented method of claim 14, wherein the remote device is a smoke detector.

17. The computer implemented method of claim 14, wherein the remote device is a carbon monoxide detector.

18. The computer implemented method of claim 14, wherein the smart furnace valve is a solenoid valve.

19. The computer implemented method of claim 14, wherein the smart register is a supply register.

20. The computer implemented method of claim 14, wherein the smart register is a return register.

* * * * *